US011904433B2

(12) United States Patent
Sytenko

(10) Patent No.: US 11,904,433 B2
(45) Date of Patent: Feb. 20, 2024

(54) AUTOMATIC GEMSTONE POLISHING ROBOT

(71) Applicant: FREEDOM AUTOMATION SOLUTIONS LLP, Surat (IN)

(72) Inventor: Ivan Nikolayevich Sytenko, Moscow (RU)

(73) Assignee: Freedom Automation Solutions LLP, Surat (IN)

( * ) Notice: Subject to any disclaimer, the term of this patent is extended or adjusted under 35 U.S.C. 154(b) by 994 days.

(21) Appl. No.: 16/641,958

(22) PCT Filed: Aug. 11, 2018

(86) PCT No.: PCT/IB2018/056070

§ 371 (c)(1),
(2) Date: Feb. 25, 2020

(87) PCT Pub. No.: WO2019/043488

PCT Pub. Date: Mar. 7, 2019

(65) Prior Publication Data

US 2020/0254584 A1 Aug. 13, 2020

(30) Foreign Application Priority Data

Aug. 31, 2017 (IN) ..... 201721030943

(51) Int. Cl.
*B24B 49/12* (2006.01)
*B24B 9/16* (2006.01)
(Continued)

(52) U.S. Cl.
CPC ..... *B24B 49/12* (2013.01); *B24B 9/161* (2013.01); *B24B 9/163* (2013.01); *B24B 9/167* (2013.01); *B24B 49/02* (2013.01); *B24B 49/16* (2013.01)

(58) Field of Classification Search
CPC ..... B24B 49/12; B24B 49/02; B24B 49/16; B24B 49/04; B24B 9/161; B24B 9/163;
(Continued)

(56) References Cited

U.S. PATENT DOCUMENTS 5,293,858 A * 3/1994 Peters ..... B24B 9/168 451/41
5,435,774 A * 7/1995 Naujok ..... B24B 9/161 451/364
5,504,303 A 4/1996 Nagy
5,816,896 A * 10/1998 Schouwenaars ..... B24B 9/16 451/10
(Continued)

FOREIGN PATENT DOCUMENTS

CN 204658127 U * 9/2015
CN 2046581237 U 9/2015
(Continued)

OTHER PUBLICATIONS

"SmartSCAN Volume-optimized cutting of uncut rough gemstones," Retrieved from the Internet <https://www.creativeinfocom.com/pdfs/smartscan-app-volume-optimized-cutting-of-gemstones.pdf>, AICON 3D Systems, retrieved on Sep. 10, 2015, 2 pages.

*Primary Examiner* — Joel D Crandall
*Assistant Examiner* — Michael A Gump
(74) *Attorney, Agent, or Firm* — Morrison & Foerster LLP

(57) ABSTRACT

The present disclosure provides a fully automatic gemstone polishing robot. An aspect of the present disclosure provides an automatic gemstone polishing robot comprising: a gemstone polishing unit, comprising a gemstone holding unit for supporting a gemstone in contact with an abrasive surface, and configured to polish said gemstone in a plurality of iterations based on a feedback signal; an image capturing unit to capture, in one or more of the plurality of iterations,
(Continued)

at least one image of the gemstone; and an image processing unit, which when executed by one or more processors, analyzes said at least one image of the gemstone with respect to one or a plurality of gemstone parameters, wherein the image processing unit is further configured to compare the one or a plurality of analyzed gemstone parameters with one or a plurality of pre-determined gemstone parameters to generate the feedback signal to be transmitted to the gemstone polishing unit. Another aspect of the present disclosure relates to a method of polishing a gemstone utilizing the automatic gemstone polishing robot.

9 Claims, 1 Drawing Sheet

(51) Int. Cl.
*B24B 49/02* (2006.01)
*B24B 49/16* (2006.01)

(58) Field of Classification Search
CPC ..... B24B 9/167; B24B 9/16; B28D 5/0064; B28D 5/0076; B28D 7/005
USPC ..... 451/5–6, 11; 125/30.01
See application file for complete search history.

(56) References Cited

U.S. PATENT DOCUMENTS

| | | | | |
|---|---|---|---|---|
| 2006/0102854 | A1* | 5/2006 | Neogi | G21K 1/093 250/492.1 |
| 2014/0033765 | A1* | 2/2014 | Holloway | B28D 5/00 703/1 |
| 2015/0009321 | A1* | 1/2015 | Goldstein | B23Q 17/2409 348/135 |
| 2018/0128608 | A1* | 5/2018 | Zhang | B23F 23/1218 |
| 2018/0143611 | A1* | 5/2018 | Wenke | B23Q 17/249 |

FOREIGN PATENT DOCUMENTS

| | | | | |
|---|---|---|---|---|
| DE | 3827752 | A1 * | 2/1990 | |
| DE | 19740044 | A1 * | 3/1999 | B24B 27/00 |
| EP | 0313369 | A2 | 4/1989 | |
| EP | 1511597 | B1 | 7/2005 | |
| IN | 242710 | B | 9/2010 | |
| JP | 2005125441 | A | 5/2005 | |
| WO | WO-1997025177 | A1 | 7/1997 | |
| WO | WO-2006/087702 | A1 | 8/2006 | |
| WO | WO-2016183663 | A1 * | 11/2016 | A63C 3/10 |

* cited by examiner

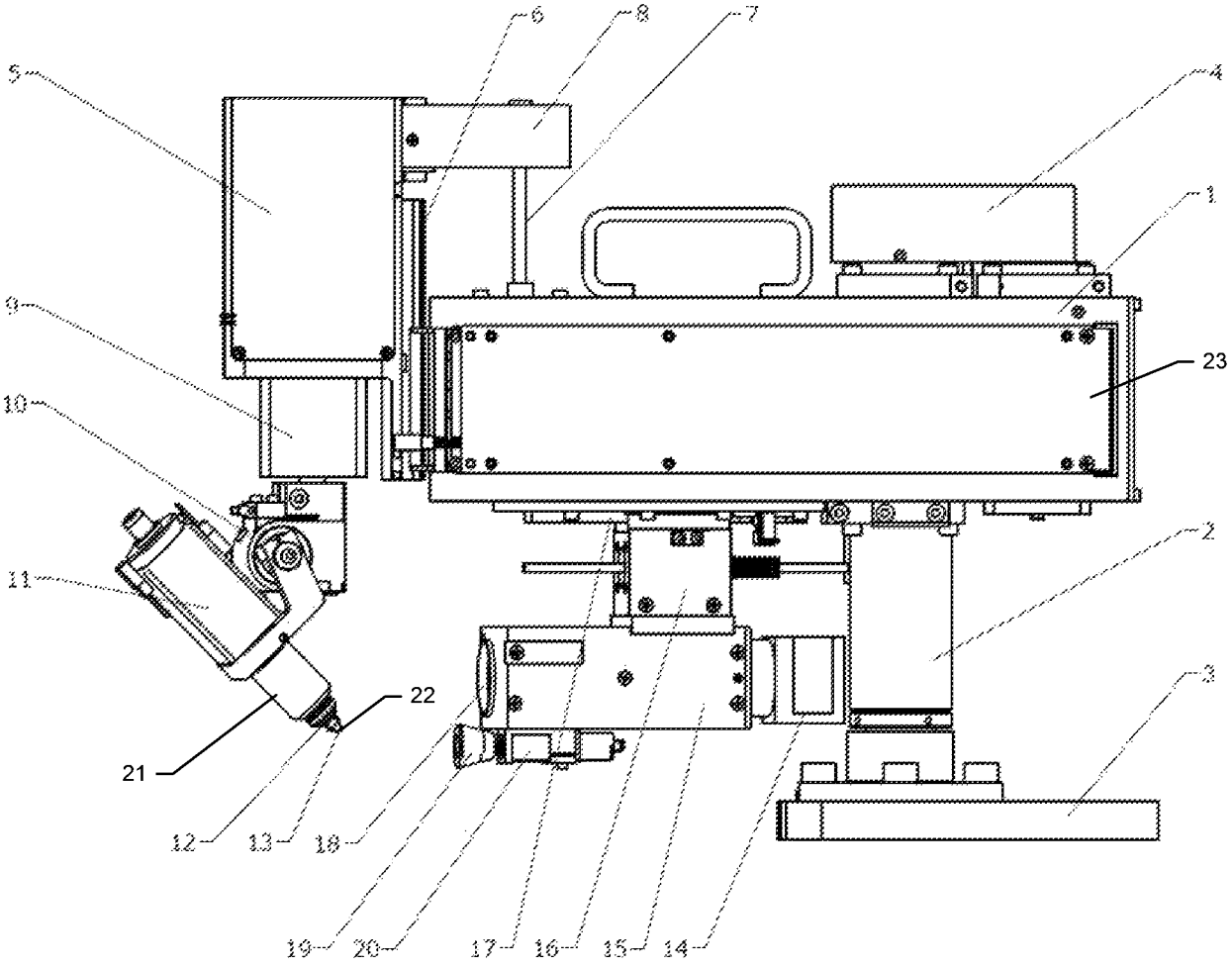
4
1
23
2
3
7
8
6
5
9
10
11
22
21
12
13
18
19
20
17
16
15
14

AUTOMATIC GEMSTONE POLISHING ROBOT

CROSS REFERENCE TO RELATED APPLICATIONS

This application is a national stage application under 35 U.S.C. § 371 of International Application No. PCT/IB2018/056070, filed internationally on Aug. 11, 2018, which claims the benefit of India Patent Application No. 201721030943, filed on Aug. 31, 2017.

TECHNICAL FIELD

The present disclosure generally relates to the field of gemstone polishing. Particularly, the present disclosure provides a fully automatic gemstone polishing robot.

BACKGROUND

Background description includes information that may be useful in understanding the present invention. It is not an admission that any of the information provided herein is prior art or relevant to the presently claimed invention, or that any publication specifically or implicitly referenced is prior art.

Gemstones, such as diamonds or turquoise, need to be cut and polished for placement in jewellery. The most precious gemstone, the diamond, is a colourless mineral made of carbon crystallized in the isometric system as octahedrons, dodecahedrons, and cubes. Approximately two hundred and fifty tons of earth needs to be moved to produce a one carat polished diamond. It requires on average a 3.5 carat rough diamond to produce a 1 carat polished diamond.

The quality and value of faceted diamonds are often described in terms of the "Four C's" namely, carat weight, colour, clarity, and cut. Conventionally, the beauty and value of a diamond rests in the hands of the craftsman. One of the vital aspects of a diamond's value is cut. The quality of the cut determines its brilliance. To obtain the maximum brilliance, the facets must be of the right size, have correct angles to each other, and their surfaces must be finely polished with irregularities not larger than a few nanometers. For diamond working purposes, the diamond is mounted on a dop held by a tang and it is levelled with respect to the working member. The diamond levelling procedure provides for the correct angles and right size of the facets. Accordingly, grinding and polishing are the most common diamond working operations. Generally, diamonds are polished mechanically on a turntable or scaife. A scaife is a heavy, cast iron, horizontally spinning wheel with a working surface impregnated with oil and diamond powder.

In processing diamonds or artificial gemstones, a diamond to be processed is generally fixed to a diamond holder and then pressed against a scaife with a certain force to form facets on the diamond. To form facets with different inclination angles with respect to a central axis of the diamond held by the holder, the diamond holder requires three types of motion modes with respect to the rotating polishing surface placed at a fixed position, namely, (i) an inclining motion mode, in which the angle of the central axis of the diamond holder is adjusted on a plane perpendicular to the polishing surface to adjust an inclination angle of a facet to be formed, (ii) a vertically feeding motion mode, in which the diamond holder holding the diamond is precisely fed vertically by an amount with respect to the polishing surface and (iii) an index motion mode, in which the diamond holder is rotated through a certain angle around the central axis to polish a facet that is close to a completely processed specific facet.

Till date, many apparatuses for polishing gemstones are constructed that can, at least partially, establish these three motion modes mechanically. However, such apparatus needs extensive human intervention in terms of requirement of manual adjustment and/or inspection of the angles, stability, vibrations and the like parameters, both before and during the operation, and hence, are far from the desired level of automation in the gemstone industry. This problem is further aggravated by the lack of precision due to assembly errors in the apparatus, mechanical deformation in use and the likes.

There is therefore, a need in the art to develop a fully automatic gemstone polishing robot that can polish and/or perform faceting of the gemstones with high level of accuracy and without any human intervention. Need is also felt of a method for polishing a gemstone utilizing a fully automatic gemstone polishing robot. The present disclosure satisfies the existing needs, inter-alia, others and overcomes the drawbacks associated with conventional apparatus and methods.

OBJECTS OF THE INVENTION

An object of the present disclosure is to overcome the disadvantages associated with the conventional gemstone polishing apparatus and method of polishing gemstones by use thereof.

Another object of the present disclosure is to provide a fully automatic gemstone polishing robot.

Another object of the present disclosure is to provide a fully automatic gemstone polishing robot that does not require human intervention.

Another object of the present disclosure is to provide a fully automatic gemstone polishing robot that has high level of accuracy and precision.

Another object of the present disclosure is to provide a method of polishing gemstones using a fully automatic gemstone polishing robot that is less time consuming.

Another object of the present disclosure is to provide a method of polishing gemstones using a fully automatic gemstone polishing robot that is easy to setup.

Another object of the present disclosure is to provide a method of polishing gemstones using a fully automatic gemstone polishing robot that is cost-effective.

SUMMARY

The present disclosure generally relates to the field of gemstone polishing. Particularly, the present disclosure provides a fully automatic gemstone polishing robot.

An aspect of the present disclosure provides an automatic gemstone polishing robot, the robot comprising: a gemstone polishing unit, comprising a gemstone holding unit for supporting a gemstone in contact with an abrasive surface, and configured to polish said gemstone in a plurality of iterations based on a feedback signal; an image capturing unit to capture, in one or more of the plurality of iterations, at least one image of the gemstone; and an image processing unit, which when executed by one or more processors, analyzes, in each of said one or more of the plurality of iterations, said at least one image of the gemstone with respect to one or a plurality of gemstone parameters, wherein the image processing unit is further configured to compare, in each of said one or more of the plurality of iterations, the one or a plurality of analyzed gemstone parameters with one or a plurality of pre-determined gemstone parameters to generate the feedback signal to be transmitted to the gemstone polishing unit.

In an implementation, the abrasive surface is centred along an axis of a mandrel. In an implementation, the gemstone polishing unit further comprises a first drive unit operatively coupled to the mandrel to confer motion to said mandrel about the axis of the mandrel. In an implementation, the gemstone polishing unit further comprises a second drive unit operatively coupled to the gemstone holding unit to provide at least one degree of motion to said gemstone holding unit. In an implementation, the second drive unit operatively coupled to the gemstone holding unit provides five or more degrees of motion.

In an implementation, the image processing unit is configured to transmit the feedback signal to any or a combination of the first drive unit and the second drive unit to control motion conferred thereby to the mandrel and the gemstone holding unit, respectively. In an implementation, the gemstone holding unit comprises any of a chuck and a clamp detachably coupled with a collet in which said gemstone is positioned. In an implementation, any of the one or a plurality of analyzed gemstone parameters and the one or a plurality of pre-determined gemstone parameters are selected from any or a combination of table size, crown angle, crown depth, girdle diameter, pavilion angle, pavilion depth, number of facets, size of facet, proportion of facets, halves, angle of facet and mutual positioning of facets. In an implementation, the image capturing unit is operatively coupled with an illumination unit that is configured to illuminate at least one facet of the gemstone. In an implementation, the image capturing unit is operatively coupled with a third drive unit. In an implementation, the image capturing unit is operatively coupled with a gemstone cleaning unit. In an implementation, the gemstone cleaning unit comprises a brush operatively coupled with a fourth drive unit. In an implementation, the automatic gemstone polishing robot further comprises a pressure sensor configured to sense gemstone pressure on said abrasive surface. In an implementation, the image capturing unit is configured to capture said at least one image of the gemstone from any angle.

Another aspect of the present disclosure relates to a method of polishing a gemstone, the method comprising the steps of: (a) holding the gemstone by a gemstone holding unit; (b) capturing at least one image of the gemstone by an image capturing unit; (c) analyzing the captured image with respect to one or a plurality of gemstone parameters by an image processing unit; (d) comparing the one or a plurality of analyzed gemstone parameters with one or a plurality of pre-determined gemstone parameters by the image processing unit; (e) transmitting a feedback signal, based on said comparison, to a gemstone polishing unit comprising the gemstone holding unit holding said gemstone; (f) contacting the gemstone against an abrasive surface based on the feedback signal; and (g) repeating the steps (b) through (f) until the one or a plurality of analyzed gemstone parameters matches with the one or a plurality of pre-determined gemstone parameters with required accuracy.

In an implementation, any of the one or a plurality of analyzed gemstone parameters and the one or a plurality of pre-determined gemstone parameters are selected from any or a combination of table size, crown angle, crown depth, girdle diameter, pavilion angle, pavilion depth, number of facets, size of facet, proportion of facets, halves, angle of facet and mutual positioning of facets. In an implementation, the step of contacting the gemstone against an abrasive surface comprises any or a combination of controlling motion of a mandrel on which the abrasive surface is mounted, and controlling motion of the gemstone holding unit, prior to or in course of contacting the gemstone against the abrasive surface based on the feedback signal. In an implementation, the steps (b) through (f) are repeated until the one or a plurality of analyzed parameters matches at least by 50% with the one or a plurality of pre-determined parameters. In an implementation, the steps (b) through (f) are repeated until the one or a plurality of analyzed parameters matches at least by 90% with the one or a plurality of pre-determined parameters.

Various objects, features, aspects and advantages of the inventive subject matter will become more apparent from the following detailed description of preferred embodiments, along with the accompanying drawing FIGURES in which like numerals represent like components.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

FIG. 1 illustrates an exemplary diagram depicting various parts/components of the automatic gemstone polishing robot, in accordance with an embodiment of the present disclosure.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed.

No language in the specification should be construed as indicating any non-claimed element essential to the practice of the invention.

Various terms as used herein are shown below. To the extent a term used in a claim is not defined below, it should be given the broadest definition persons in the pertinent art have given that term as reflected in printed publications and issued patents at the time of filing.

The term "gemstone" used herein throughout the present disclosure encompass, within its scope, natural as well as synthetic diamonds and other precious and semi-precious stones, as known to or appreciated by a person skilled in the pertinent art.

The present disclosure generally relates to the field of gemstone polishing. Particularly, the present disclosure provides a fully automatic gemstone polishing robot.

An aspect of the present disclosure provides an automatic gemstone polishing robot, the robot comprising: a gemstone polishing unit, comprising a gemstone holding unit for supporting a gemstone in contact with an abrasive surface, and configured to polish said gemstone in a plurality of iterations based on a feedback signal; an image capturing unit to capture, in one or more of the plurality of iterations, at least one image of the gemstone; and an image processing unit, which when executed by one or more processors, analyzes, in each of said one or more of the plurality of iterations, said at least one image of the gemstone with respect to one or a plurality of gemstone parameters, wherein the image processing unit is further configured to compare, in each of said one or more of the plurality of iterations, the one or a plurality of analyzed gemstone parameters with one or a plurality of pre-determined gemstone parameters to generate the feedback signal to be transmitted to the gemstone polishing unit.

In an implementation, the abrasive surface is centred along an axis of a mandrel. In an implementation, the gemstone polishing unit further comprises a first drive unit operatively coupled to the mandrel to confer motion to said mandrel about the axis of the mandrel. In an implementation, the gemstone polishing unit further comprises a second drive unit operatively coupled to the gemstone holding unit to provide at least one degree of motion to said gemstone holding unit. In an implementation, the second drive unit operatively coupled to the gemstone holding unit provides five or more degrees of motion.

In an implementation, the image processing unit is configured to transmit the feedback signal to any or a combination of the first drive unit and the second drive unit to control motion conferred thereby to the mandrel and the gemstone holding unit, respectively. In an implementation, the gemstone holding unit comprises any of a chuck and a clamp detachably coupled with a collet in which said gemstone is positioned. In an implementation, any of the one or a plurality of analyzed gemstone parameters and the one or a plurality of pre-determined gemstone parameters are selected from any or a combination of table size, crown angle, crown depth, girdle diameter, pavilion angle, pavilion depth, number of facets, size of facet, proportion of facets, halves, angle of facet and mutual positioning of facets. In an implementation, the image capturing unit is operatively coupled with an illumination unit that is configured to illuminate at least one facet of the gemstone. In an implementation, the image capturing unit is operatively coupled with a third drive unit. In an implementation, the image capturing unit is operatively coupled with a gemstone cleaning unit. In an implementation, the gemstone cleaning unit comprises a brush operatively coupled with a fourth drive unit. In an implementation, the automatic gemstone polishing robot further comprises a pressure sensor configured to sense gemstone pressure on said abrasive surface. In an implementation, the image capturing unit is configured to capture said at least one image of the gemstone from any angle.

Another aspect of the present disclosure relates to a method of polishing a gemstone, the method comprising the steps of: (a) holding the gemstone by a gemstone holding unit; (b) capturing at least one image of the gemstone by an image capturing unit; (c) analyzing the captured image with respect to one or a plurality of gemstone parameters by an image processing unit; (d) comparing the one or a plurality of analyzed gemstone parameters with one or a plurality of pre-determined gemstone parameters by the image processing unit; (e) transmitting a feedback signal, based on said comparison, to a gemstone polishing unit comprising the gemstone holding unit holding said gemstone; (f) contacting the gemstone against an abrasive surface based on the feedback signal; and (g) repeating the steps (b) through (f) until the one or a plurality of analyzed gemstone parameters matches with the one or a plurality of pre-determined gemstone parameters with required accuracy. The term "required accuracy" as used herein denotes achieving a condition, wherein the one or a plurality of analyzed gemstone parameters matches with the one or a plurality of pre-determined gemstone parameters at least by required/desired percentage, for example, the required accuracy may be a condition wherein the one or a plurality of analyzed gemstone parameters matches with the one or a plurality of pre-determined gemstone parameters by 50%. Accordingly, a person skilled in the pertinent art would appreciate that the method of the present disclosure can also be advantageously utilized to realize a semi-polished gemstone, and application of the method of the present disclosure is not limited to realize the polished gemstones.

In an implementation, any of the one or a plurality of analyzed gemstone parameters and the one or a plurality of pre-determined gemstone parameters are selected from any or a combination of table size, crown angle, crown depth, girdle diameter, pavilion angle, pavilion depth, number of facets, size of facet, proportion of facets, halves, angle of facet and mutual positioning of facets. In an implementation, the step of contacting the gemstone against the abrasive surface of a mandrel comprises any or a combination of controlling motion of a mandrel on which the abrasive surface is mounted, and controlling motion of the gemstone holding unit, prior to or in course of contacting the gemstone against the abrasive surface based on the feedback signal. In an implementation, the steps (b) through (f) are repeated until the one or a plurality of analyzed parameters matches at least by 10% with the one or a plurality of pre-determined parameters. In an implementation, the steps (b) through (f) are repeated until the one or a plurality of analyzed parameters matches at least by 50% with the one or a plurality of pre-determined parameters. In an implementation, the steps (b) through (f) are repeated until the one or a plurality of analyzed parameters matches at least by 90% with the one or a plurality of pre-determined parameters. In an implementation, the steps (b) through (f) are repeated until the one or a plurality of analyzed parameters matches with the one or a plurality of pre-determined parameters.

FIG. 1 illustrates an exemplary diagram depicting various parts/components of the automatic gemstone polishing robot, in accordance with an implementation of the present disclosure. As can be seen from FIG. 1, the automatic gemstone polishing robot includes a gemstone polishing unit, including a gemstone holding unit (21) for supporting a gemstone (22) in contact with an abrasive surface (not shown), and configured to polish said gemstone; an image capturing unit (14) to capture at least one image of the gemstone; and an image processing unit (23) to analyze said at one captured image with respect to any or a combination of gemstone parameters. In an implementation, the gemstone polishing unit includes a gemstone holding unit, an abrasive surface (such as a scaife and the likes), and drive unit(s) to position the gemstone in a desired orientation against the abrasive surface. A person skilled in the art would appreciate that any other device/component can also form part of the gemstone polishing unit that can effect and/or aid in polishing of the gemstone without departing from the scope and spirit of the present disclosure. Further, it is to be appreciated that although, the components/devices such as a gemstone holding unit, an abrasive surface (such as a scaife and the likes), and drive unit(s) are generally described herein as part of the gemstone polishing unit, the same can be so configured or arranged or operatively coupled such that the same, in effect, yields desired polishing of the gemstone.

In an embodiment, the gemstone parameters are selected from a group including table size, crown angle, crown depth, girdle diameter, pavilion angle, pavilion depth, number of facets, size of facets, proportions of facets, halves, angle of facet, mutual positioning of facets, but not limited thereto. In an embodiment, the image processing unit can be configured either in the image capturing unit (14) itself such as in a camera, or can be configured in a remote server that the apparatus/robot is operatively/communicatively coupled with such that the captured image can be processed/evaluated with respect to any or a combination of gemstone parameters. The processing unit can be a simple processor or a group of one or more processors that can also be configured very much within the apparatus/robot itself and be operatively coupled with the image capturing unit (14) so as to, in real-time, process the images captured by the image capturing unit (14) (such as a camera).

In an implementation, the base (3) can be detachably coupled with a mandrel with an abrasive surface centred along its axis (e.g. a scaife and the like, not shown in the FIGURE). In an implementation, the scaife is supported on a mandrel. In an implementation, the mandrel can be coupled to a first drive unit to confer movement and/or motion thereto.

In an implementation, the base (3) includes a turn axis (2) vertically mounted thereon, and a balk (1) to cater to the angle and height alignment with respect to the abrasive surface (a rotating scaife and the like). In an implementation, the balk (1) is configured with a balk turn drive (4) to confer motion thereto relative to the base (3) and/or the abrasive surface. At one end of the balk (1), head (5) is mounted, which is capable of moving vertically with the help of a guide (6) and a drive (7). In an implementation, the head is further coupled to a pressure sensor (8).

In an implementation, the head (5) further includes any or a combination of a turn drive (9) for selecting/changing the direction of polishing, a turn drive (10) for selecting/changing the angle of the polishing and a spindle with a facet selection rotary drive (11); and a gemstone holding unit (21) including a pneumatic chuck (12) in which a collet (13) with a gemstone can be fixed.

In an implementation, any or a combination of a turn drive (9) for selecting/changing the direction of polishing, a turn drive (10) for selecting/changing the angle of the polishing and a spindle with a facet selection rotary drive (11) forms the second drive unit, operation of which is controlled by the feedback signal. In an alternative implementation, any or a combination of turn axis (2), balk turn drive (4), drive (7), turn drive (9), a turn drive (10) and the facet selection rotary drive (11) forms the second drive unit, operation of which is controlled by the feedback signal. Although the term "second drive unit" as used herein throughout the present disclosure is explained with respect to the driving unit including a drive unit for selecting/changing the direction of polishing, a drive unit for selecting/changing the angle of the polishing, a facet selection rotary drive and the likes, it should be appreciated that any other drive unit, either configured as part of the device or otherwise, as known to or appreciated by a person skilled in the pertinent art, which in effect controls or aid in controlling the orientation of the gemstone in relation to the abrasive surface (such as scaife) so as to control or aid in controlling the polishing of the gemstone, is within the scope of the term "second drive unit".

In an implementation, the base (3) is detachably coupled with an image capturing unit (14). In an implementation, the image capturing unit (14) is encased, at least in part, in a housing (15). In an implementation, housing (15) further includes one or a plurality of optical lens and at least one lighting unit (18). In an implementation, the housing (15) with image capturing unit (14), one or a plurality of optical lens and at least one lighting unit (18) (alternatively and synonymously termed as "an illumination unit") is detachably coupled to the balk (1) with the help of a guide (17) and a third drive unit (16) to confer longitudinal movement thereto. Alternatively, the at least one lighting unit (18) and a third drive unit (16) can be configured as a separate unit, segregated from the housing (15) encasing the image capturing unit. A person skilled in the art should appreciate that the illumination unit and the image capturing unit can be suitably positioned/configured as part of the robot, relative to the gemstone, so as to suit the method of polishing of the gemstone. For example, the illumination unit can be configured at a suitable angle relative to the image capturing unit such that one or a plurality of facets of the gemstone under processing can be appropriately illuminated and/or whole of the gemstone can be illuminated, and one or a plurality of images of the gemstone/facet(s) of the gemstone can be captured. As illustrated in FIG. 1, the illumination unit and the image capturing unit can be positioned on the same side/face relative to the gemstone held by a gemstone holding unit. Alternatively, the illumination unit can be configured in parallel and in an opposite direction relative to the image capturing unit, in case profile cutting method is opted, in which case the gemstone is illuminated from one side and one or a plurality of the images are taken from the opposite side. In an implementation, the illumination unit is configured to illuminate the gemstone from a suitable angle. In an implementation, the image capturing unit is configured to capture at least one image of the gemstone from any angle.

In an embodiment, the illuminating unit can include LED or incandescent light or any other illuminating unit as known to or appreciated by a person skilled in the art without departing from the scope and spirit of the present disclosure. In an embodiment, a plurality of illuminating units, one dedicated to each of the facet is operatively coupled to the automatic gemstone polishing robot. Alternatively, a single illuminating unit can be configured as part of the robot to illuminate a facet under processing. Alternatively, a single illuminating unit can be configured to illuminate a plurality of facets under processing. Alternatively, the illuminating unit can be configured to illuminate the whole gemstone under processing. In an embodiment, the automatic gemstone polishing robot includes at least one illuminating unit to illuminate any or a combination of: a facet under processing, a plurality of facets under processing, and the gemstone under processing. The illuminating unit primarily facilitates the image capturing device to capture the images of the gemstone/stone under the processing.

In an implementation, a gemstone cleaning unit such as, but not limited to, a brush (19) is coupled to the housing (15) to afford cleaning of the diamond being polished. In an implementation, the brush (19) is coupled with a fourth drive unit (20) to confer motion/movement thereto. In an alternative implementation, the gemstone cleaning unit includes a combination of a brush and a gemstone cleaning material. However, any other gemstone cleaning unit can be utilized, as known to or appreciated by a person skilled in the art, to clean the gemstone under processing without departing from the scope and spirit of the present disclosure.

In an embodiment, the automatic gemstone polishing robot is provided with a repository with a master price list or rappaport including a plurality of pre-determined gemstone parameters like table size, crown angle, crown depth, girdle diameter, pavilion angle, pavilion depth, number of facets, size of facets and proportions of facets, but not limited thereto, stored therein. In an alternative embodiment, the automatic gemstone polishing robot can be operatively coupled to a computing device with a master price list or rappaport including a plurality of pre-determined (also interchangeably referred to as desired gemstone parameters) gemstone parameters like table size, crown angle, crown depth, girdle diameter, pavilion angle, pavilion depth, number of facets, size of facets and proportions of facets, but not limited thereto. In an alternative embodiment, the automatic gemstone polishing robot can be provided with an input device to facilitate and/or enter the pre-determined gemstone parameters like table size, crown angle, crown depth, girdle diameter, pavilion angle, pavilion depth, number of facets, size of facets, proportions of facets, halves, angle of facet and mutual positioning of facets, but not limited thereto, by a user. In an alternative embodiment, the automatic gemstone polishing robot can be provided with an input device to facilitate and/or enter the pre-designed (i.e. desired) cut project (image) that need to be produced from the rough or semi-polished gemstone using the automatic gemstone polishing robot of the present disclosure.

In an embodiment, the image capturing device captures one or a plurality of images of the rough or semi-polished gemstone. In an embodiment, the image capturing device is capable of moving to capture the images of the rough or semi-polished gemstone from different angles. In an alternative embodiment, the image capturing device is still while the gemstone holding device is capable of moving to capture the images of the rough or semi-polished gemstone from different angles. In still further embodiment, both the image capturing device and the gemstone holding device are capable of moving relative to each other to capture the images of the rough or semi-polished gemstone from different angles.

In an embodiment, the automatic gemstone polishing robot is capable of analyzing the captured image(s) with respect to the one or more gemstone parameters including table size, crown angle, crown depth, girdle diameter, pavilion angle, pavilion depth, number of facets, sizes of facets, proportions of facets, halves, angle of facet and mutual positioning of facets. In an embodiment, the automatic gemstone polishing robot is capable of comparing the analyzed parameters with the pre-determined gemstone parameters provided to the automatic gemstone polishing robot via any or a combination of: providing a repository, containing a master price list or rappaport including a plurality of pre-determined gemstone parameters, operatively coupled with the automatic gemstone polishing robot; providing a computing device, containing a master price list or rappaport including a plurality of pre-determined gemstone parameters, operatively coupled with the automatic gemstone polishing robot; an input device, operatively coupled with the automatic gemstone polishing robot to facilitate the input of and/or to enter the pre-determined gemstone parameters by the user; and an input device to facilitate and/or enter the pre-designed cut project (image) by the user that need to be produced from the rough or semi-polished gemstone.

In an embodiment, the automatic gemstone polishing robot is configured to polish the gemstone in a plurality of iterations. Preferably, in each iteration, the operation of the gemstone polishing unit is controlled by way of a feedback signal. The image capturing unit captures, in one or more of the plurality of iterations, at least one image of the gemstone and the image processing unit analyzes, in each of said one or more of the plurality of iterations, the at least one image of the gemstone with respect to one or a plurality of gemstone parameters. Further, the image processing unit compares, in each of said one or more of the plurality of iterations, the one or a plurality of analyzed gemstone parameters with one or a plurality of pre-determined gemstone parameters to generate the feedback signal to be transmitted to the gemstone polishing unit. Based on the feedback signal, operation of the gemstone polishing unit is controlled (e.g. by controlling operation of any or a combination of the first drive unit and the second drive unit). For example, a diamond to be polished is firstly held by the gemstone holding unit and at least image is captured by the image capturing unit. The image processing unit then analyzes the captured image to assess the crown angle of the diamond. The measured crown angle is then compared by the image processing unit with the desired/pre-determined crown angle. Based on the comparison, the image processing unit generates a feedback signal to be transmitted to the gemstone polishing unit. Based on the feedback signal, operation of any or a combination of the turn axis (2), balk turn drive (4), drive (7), turn drive (9), turn drive (10), and a spindle with a facet selection rotary drive (11) is/are controlled for holding the diamond against the rotating scaife in a desired orientation such that crown angle with a value nearer/closer to the desired/pre-determined crown angle is achieved. The diamond is then cleaned by the cleaning brush and one or more images thereof are captured by the image capture unit. The image processing unit again analyzes the captured image(s) with respect to the crown angle of the diamond, compares it with the desired crown angle and generate the feedback signal. Once, desired crown angle is achieved, faceting may be done i.e. each facet is worked one by one to yield the polished gemstone with desired gemstone parameters. Accordingly, the overall operation of the gemstone polishing unit is precisely controlled by the feedback signal without any human intervention.

In an embodiment, the automatic gemstone polishing robot is capable of controlling the polishing and/or faceting of the rough or semi-polished gemstone based on the comparison of analyzed gemstone parameters with that of the pre-determined gemstone parameters. Accordingly, the automatic gemstone polishing robot of the present disclosure do not rely on the indirect methods of evaluation of parameters viz. by measuring the mutual arrangement of the mechanical parts of the cutting/polishing machine as is done in the conventional systems and methods utilizing them. Rather, the automatic gemstone polishing robot of the present disclosure performs direct optical measurement of the stone or gemstone under observation by capturing one or more images thereof and then performing analysis of the captured images. Accordingly, the processing of automatic gemstone polishing robot of the present disclosure neither requires conventional mechanical elements such as contact rings for setting-up the polishing parameters, not does it require human intervention for controlling the polishing process, greatly enhancing the level of precision and accuracy. Further, automatic gemstone polishing robot of the present disclosure has at least 5 degrees of motion including shaping motion (to exert desired control over the choice of face, face angle and face height) and technological motion (such as oscillation, direction of grinding and the likes) that enables precise control over the polishing process of the gemstone.

In an embodiment, the gemstone is polished and/or faceted in accordance with the pre-designed cut project (image) in a multi-step process. In an embodiment, each of the sides/facets are worked upon one after another. In an embodiment, individual tiers of facets are applied one after another. In an embodiment, the facets are applied under the projected angles. In an embodiment, the points or lines of intersection of facets of the same level or facets of different levels can serve as the starting point for measuring the dimensions of the facets. For example, when cutting the top of a round gemstone, the size of the main facet can be defined as the height in the profile image of the stone from the side of the girdle or as the height on the front of the stone from the side of the site. In accordance with the proposed method, facets can be measured an image processing unit. In an embodiment, the image capturing device can be a television camera equipped with an optical lens. However, any other image capturing device, as known to or appreciated by a person skilled in the art, can be utilized to serve its intended purpose, as laid down in the embodiments of the present disclosure without departing from the scope and spirit of the present disclosure. The term "image capturing unit" as used herein throughout the present disclosure denotes a camera, a video capturing device and the likes, as known to or appreciated by a person skilled in the art, to sub-serve its intended purpose as laid down in embodiments of the present disclosure.

In an embodiment, the first drive unit provides two degree of motion to the mandrel with the respect to the mandrel axis. In an embodiment, the first drive unit provides an angular motion and an axial motion to the mandrel with respect to the mandrel axis. The first drive unit can include any of the actuators including linear actuators and the likes, pneumatic or electric motors including stepper motor and the likes, as known to or appreciated by a person skilled in the art, to serve its intended purpose as laid down in the embodiments of the present disclosure, without departing from the scope and spirit of the present invention.

In an embodiment, the gemstone holding unit can include jigs, fixtures and the like holding mechanisms, as known to or appreciated by a person skilled in the art, to serve its intended purpose as laid down in the embodiments of the present disclosure. In an implementation, the gemstone holding unit includes a chuck or clamp so as to secure a collet on which a gemstone to be polished is positioned.

In an embodiment, the automatic gemstone polishing robot further includes a controller operatively coupled with (i) the image processing unit and (ii) any or a combination of said first drive unit and said second drive unit. In an embodiment, the image processing unit is configured to transmit signals to said controller to control polishing of the gemstone. The controller can be configured on any computing device as known to a person skilled in the art.

Another aspect of the present disclosure relates to a method of polishing a gemstone, the method comprising the steps of: (a) holding the gemstone by a gemstone holding unit; (b) capturing at least one image of the gemstone by an image capturing unit; (c) analyzing the captured image with respect to one or a plurality of gemstone parameters by an image processing unit; (d) comparing the one or a plurality of analyzed gemstone parameters with one or a plurality of pre-determined gemstone parameters by the image processing unit; (e) transmitting a feedback signal, based on said comparison, to a gemstone polishing unit comprising the gemstone holding unit holding said gemstone; (f) contacting the gemstone against an abrasive surface based on the feedback signal; and (g) repeating the steps (b) through (f) until the one or a plurality of analyzed gemstone parameters matches at least by 50% with the one or a plurality of pre-determined gemstone parameters.

In an embodiment, the step of contacting the gemstone against the abrasive surface of a mandrel includes any or a combination of providing at least one degree motion to the mandrel with respect to the mandrel axis by the first drive unit and providing at least one degree of motion to the gemstone holding unit relative to the mandrel by the second drive unit. In an embodiment, the step of contacting the gemstone against the abrasive surface of a mandrel comprises any or a combination of controlling motion of a mandrel on which the abrasive surface is mounted, and controlling motion of the gemstone holding unit, prior to or in course of contacting the gemstone against the abrasive surface based on said feedback signal. For example, based on the feedback signal, desired orientation of the gemstone relative to the abrasive surface is achieved by controlling the motion of any or a combination of a turn drive (9) for selecting/changing the direction of polishing, a turn drive (10) for selecting/changing the angle of the polishing and a spindle with a facet selection rotary drive (11).

In an embodiment, said steps (b) through (f) are repeated until the any or a combination of analyzed parameters matches at least by 70% with the any or a combination of pre-determined parameters. In an embodiment, said steps (b) through (f) are repeated until the any or a combination of analyzed parameters matches at least by 90% with the any or a combination of pre-determined parameters. In an embodiment, said steps (b) through (f) are repeated until the any or a combination of analyzed parameters matches at least by 97% with the any or a combination of pre-determined parameters. In an embodiment, said steps (b) through (f) are repeated until the any or a combination of analyzed parameters matches absolutely with the any or a combination of pre-determined parameters.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

Advantages of the Invention

The present disclosure provides a fully automatic gemstone polishing robot that overcomes the disadvantages associated with the conventional gemstone polishing apparatus.

The present disclosure provides a fully automatic gemstone polishing robot.

The present disclosure provides a fully automatic gemstone polishing robot that does not require human intervention.

The present disclosure provides a fully automatic gemstone polishing robot that has high level of accuracy and precision.

The present disclosure provides a method of polishing gemstones a fully automatic gemstone polishing robot that is less time consuming.

The present disclosure provides a method of polishing gemstones a fully automatic gemstone polishing robot that is easy to setup.

The present disclosure provides a method of polishing gemstones a fully automatic gemstone polishing robot that is cost-effective.

I claim:

1. An automatic gemstone polishing robot, the robot comprising:

a gemstone polishing unit comprising a gemstone holding unit for supporting a gemstone, and configured to polish said gemstone in a plurality of iterations based on a feedback signal;

an image capturing unit to capture, in one or more of the plurality of iterations, at least one image of the gemstone; and an image processing unit, which when executed by one or more processors, analyzes, in each of said one or more of the plurality of iterations, said at least one image of the gemstone with respect to one or a plurality of gemstone parameters, wherein the image processing unit is further configured to compare, in each of said one or more of the plurality of iterations, the one or the plurality of analyzed gemstone parameters with one or a plurality of pre-determined gemstone parameters to generate the feedback signal to be transmitted to the gemstone polishing unit, wherein the image capturing unit is operatively coupled with a gemstone cleaning unit, wherein the gemstone cleaning unit comprises a brush operatively coupled with a fourth drive unit.

2. The automatic gemstone polishing robot as claimed in claim 1, wherein the gemstone polishing unit further comprises a second drive unit operatively coupled to the gemstone holding unit to provide at least one degree of motion to said gemstone holding unit.

3. The automatic gemstone polishing robot as claimed in claim 2, wherein the second drive unit provides five or more degrees of motion.

4. The automatic gemstone polishing robot as claimed in claim 1, wherein said gemstone holding unit comprises any of a chuck and a clamp, wherein any of the chuck and the clamp is detachably coupled with a collet in which said gemstone is positioned.

5. The automatic gemstone polishing robot as claimed in claim 1, wherein any of the one or the plurality of analyzed gemstone parameters and the one or the plurality of predetermined gemstone parameters are selected from any or a combination of table size, crown angle, crown depth, girdle diameter, pavilion angle, pavilion depth, number of facets, size of facet, proportion of facets, halves, angle of facet and mutual positioning of facets.

6. The automatic gemstone polishing robot as claimed in claim 1, wherein the image capturing unit is operatively coupled with an illumination unit that is configured to illuminate at least one facet of the gemstone.

7. The automatic gemstone polishing robot as claimed in claim 1, wherein the image capturing unit is operatively coupled with a third drive unit.

8. The automatic gemstone polishing robot as claimed in claim 1, wherein the automatic gemstone polishing robot further comprises a pressure sensor configured to sense pressure.

9. The automatic gemstone polishing robot as claimed in claim 1, wherein the image capturing unit is configured to capture said at least one image of the gemstone from any angle.

* * * * *